US005253810A

United States Patent [19]

Maltby et al.

[11] Patent Number: 5,253,810

[45] Date of Patent: Oct. 19, 1993

[54] HIGH HEAT, HIGH PRESSURE, NON-CORROSIVE INJECTOR ASSEMBLY

[75] Inventors: John D. Maltby; Leonard J. Martini, both of San Diego, Calif.

[73] Assignee: The United States of America as represented by the Secretary of the Navy, Washington, D.C.

[21] Appl. No.: 850,635

[22] Filed: Mar. 13, 1992

[51] Int. Cl.[5] ..... B05B 15/06

[52] U.S. Cl. ..... 239/397.5; 239/132.3; 239/DIG. 19; 285/187; 285/917; 60/39.32

[58] Field of Search ..... 239/397.5, 132.3, DIG. 19; 285/187, 917, 111; 60/753, 39.32; 416/241 B

[56] References Cited

U.S. PATENT DOCUMENTS

| | | | |
|---|---|---|---|
| 754,103 | 3/1904 | Thornley | 239/132.3 |
| 1,436,351 | 11/1922 | Metcalfe | 239/434 |
| 3,012,802 | 12/1961 | Waite | 285/917 |
| 3,076,607 | 2/1963 | Cordier . | |
| 3,843,170 | 10/1974 | Bagnulo . | |
| 3,968,982 | 7/1976 | Belicic . | |
| 3,984,131 | 10/1976 | Gingrich, Jr. et al. . | |
| 4,028,888 | 6/1977 | Pilarczyk | 60/39.32 |
| 4,239,242 | 12/1980 | Burns | 285/111 |
| 4,281,941 | 8/1981 | Rottenkolber | 416/241 B |
| 4,784,043 | 11/1988 | Kobayashi et al. | 239/434 |
| 4,838,581 | 6/1989 | Oda et al. . | |
| 4,863,105 | 9/1989 | Bennett | 239/397.5 |
| 4,891,935 | 1/1990 | McLaurin et al. | 239/397.5 |

FOREIGN PATENT DOCUMENTS

| | | | |
|---|---|---|---|
| 3805933 | 9/1989 | Fed. Rep. of Germany . | |
| 2365275 | 5/1978 | France . | |
| 0079918 | 6/1980 | Japan | 239/397.5 |

*Primary Examiner*—Andres Kashnikow
*Assistant Examiner*—Karen B. Merritt
*Attorney, Agent, or Firm*—Harvey Fendelman; Thomas Glenn Keough

[57] ABSTRACT

An injector assembly is provided for use with a high heat, high pressure combustion chamber which utilizes a highly corrosive fuel. The injector assembly includes a ceramic injector which has an annular ceramic flange. A metallic retaining apparatus is provided which includes a pair of retainer plates and a tightening device. In a preferred embodiment one of the retainer plates is a retainer ring. With this arrangement the ceramic flange is clamped between the retainer ring and the retainer plate by the tightening device. The retainer ring is provided with an annular groove. An annular spring is disposed within the groove in engagement with the ceramic flange. Because of the different coefficients of expansion the metal of the retaining apparatus will expand away from the ceramic flange when the combustion chamber is operated. When this occurs the annular spring will expand to maintain a high integrity seal between the injector assembly and the combustion chamber. Also, the injector is provided with an annular cavity which is structurally supported and cooled therein by a coolant.

12 Claims, 4 Drawing Sheets (BOILER ON)

(BOILER ON)

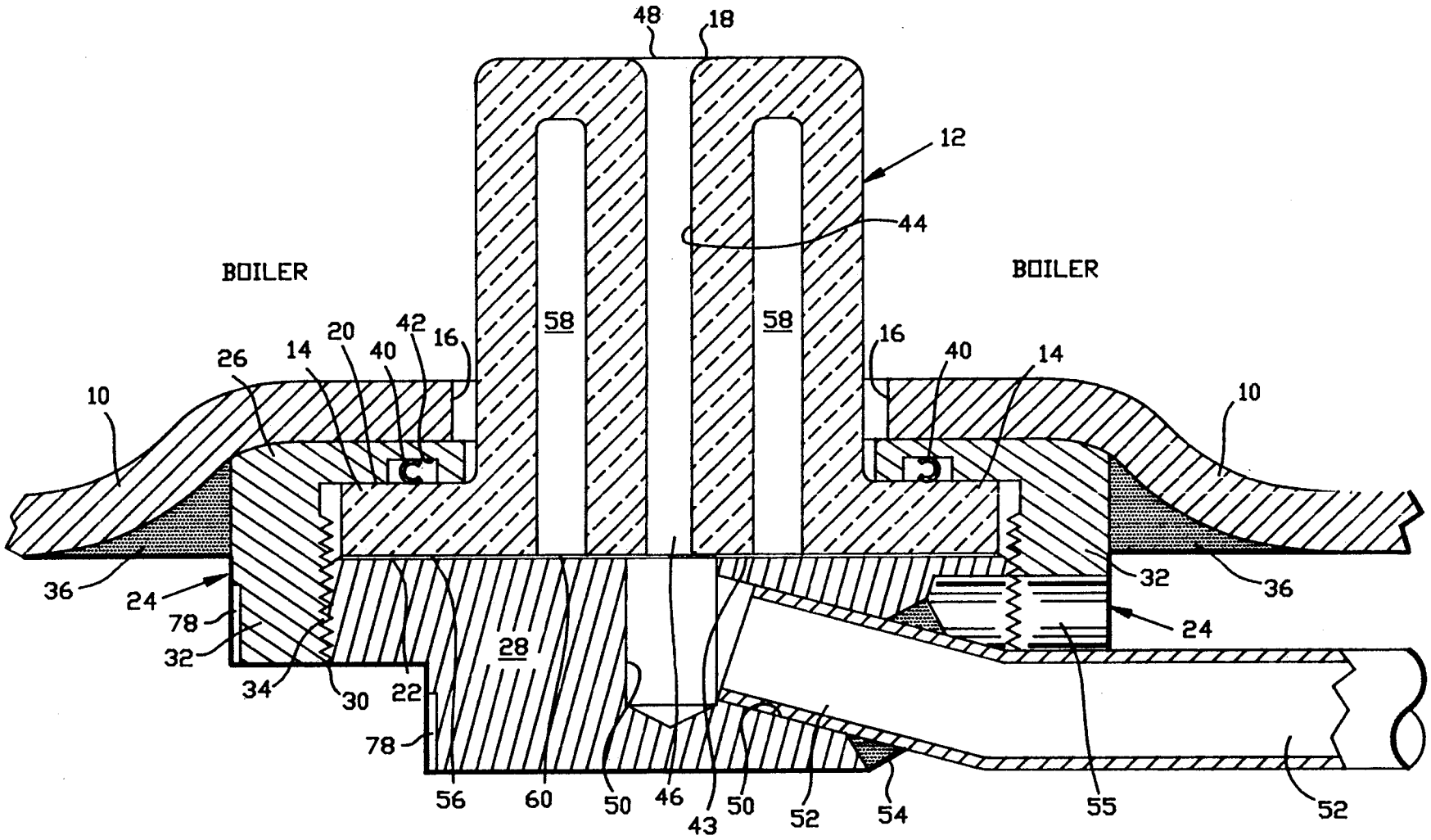
FIG. 1 (BOILER OFF)

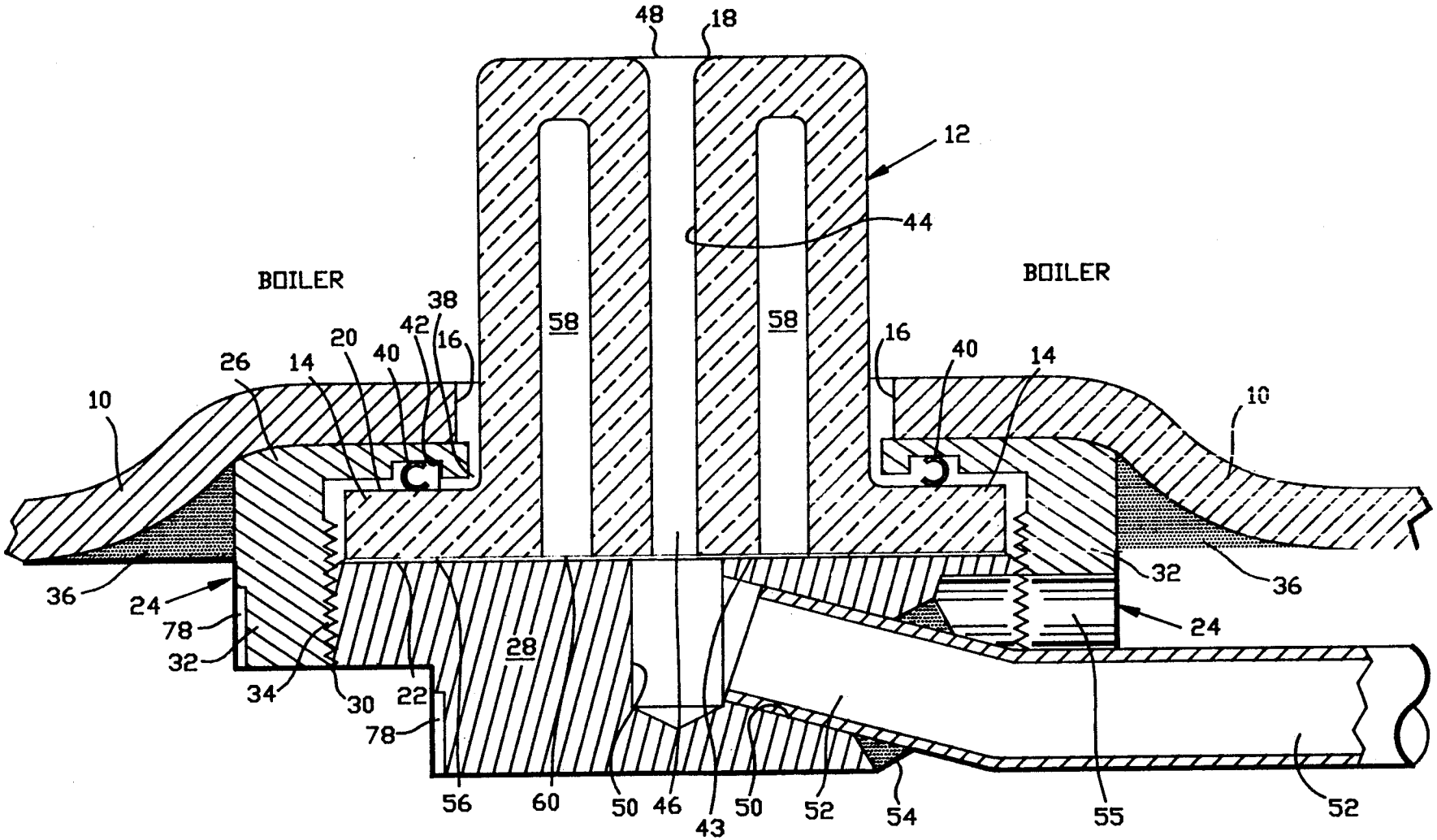
FIG. 2 (BOILER ON)

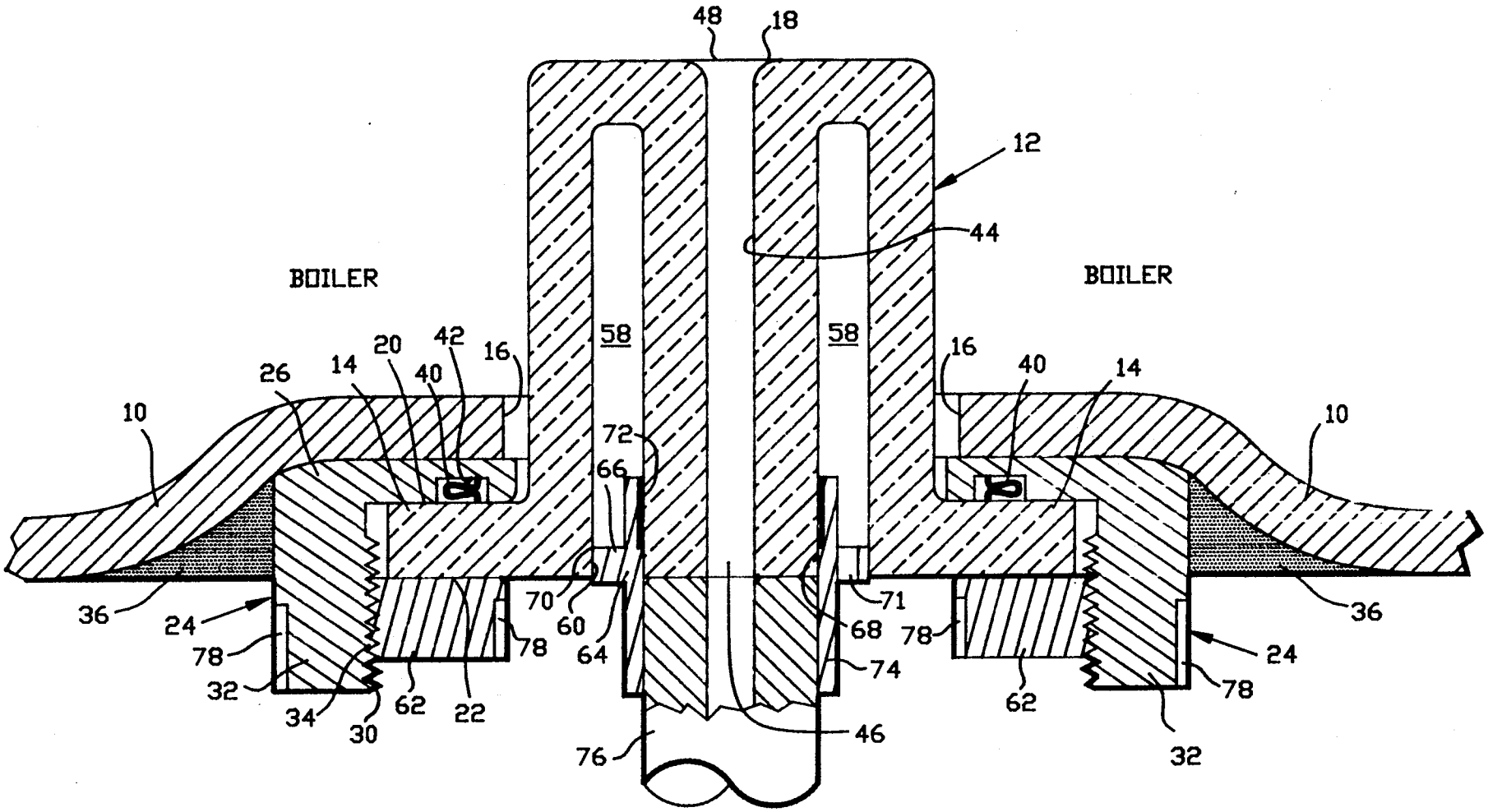
FIG. 3 (BOILER OFF)

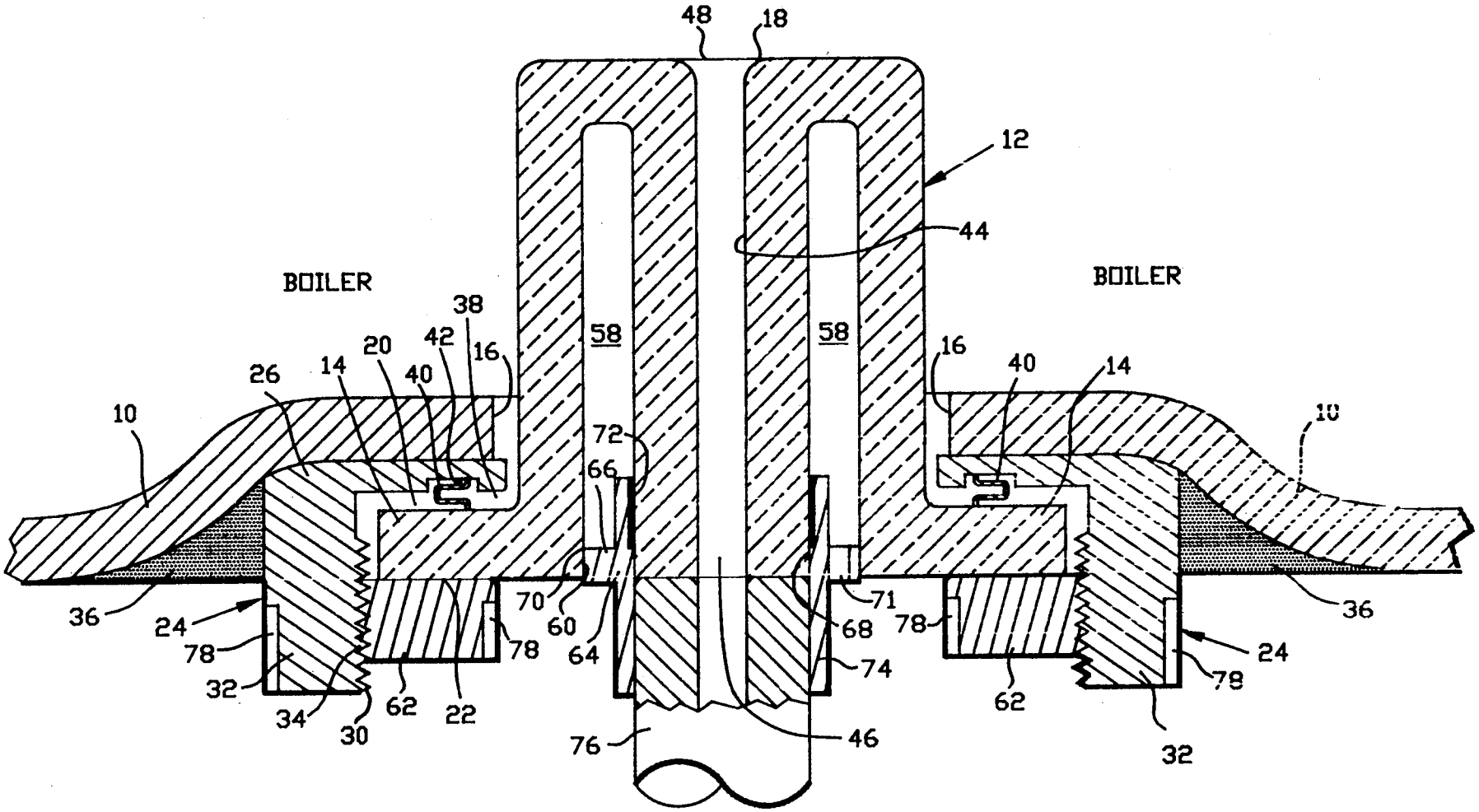
FIG. 4 (BOILER ON)

HIGH HEAT, HIGH PRESSURE, NON-CORROSIVE INJECTOR ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Navy torpedoes are most commonly driven by a hot gas turbine. The driven gases are provided by a high heat, high pressure combustion chamber or boiler. The boiler commonly reaches a temperature of 1700 degrees fahrenheit and the pressure reaches 300 psi.

In order to supply fuel for running the boiler an injector extends into the boiler and is mounted to the boiler with some sort of sealing apparatus. The fuel that is commonly used is lithium sulfurhexafluoride which is desirable because of its high energy to volume ratio, but is undesirable because of its extreme corrosive effect on metals.

To deal with the hostile environment of the torpedo boiler the Navy has been using an injector assembly which utilizes a tungsten sealed injector within a hastelloy housing. The injector assembly is mounted by welding the hastelloy housing to an exterior stainless steel wall of the boiler. Even though the tungsten and hastelloy metals are the best known for withstanding the hostile environment the tungsten sometimes cracks and disassociates itself from the hastelloy housing due to the high heat and the corrosive effect of the high energy fuel utilized. This causes the seal to break, whereupon high pressure gases escape from the boiler.

In order to overcome the tungsten corrosion problem the Navy has been very desirous of using a ceramic injector. Ceramic injectors are well known in the prior art, and the right kind of ceramic injector will withstand the hostile high heat, high pressure, corrosive environment of a torpedo boiler. However, the prior art is silent on how to attach a ceramic injector to the boiler so that it can withstand the hostile environment. With prior art attachment devices the high heat expands the parts at different rates causing the parts to break away from one another, thus allowing high pressure gas to escape. For instance, where the ceramic injector is attached to a stainless steel boiler the boiler material expands away from the ceramic injector by a factor of 30 to 1. This leaves no chance to maintain a seal between the injector and the boiler by a direct welded connection. Prior art metal mounting apparatuses for ceramic injectors suffer the same problems, namely, a radical difference in expansion rates causing any sealing attempts to fail. What is needed is an apparatus for retaining the ceramic injector to the boiler so that it won't fail when subjected to the hostile environment which is necessary to make the torpedo efficient.

SUMMARY OF THE INVENTION

The present invention solves a long-standing problem of inadequate injectors for torpedo boilers. By use of the present invention a ceramic injector can be utilized in a hostile torpedo boiler environment without the problem of seal failure at the juncture of the mounting. This has been accomplished by providing a unique arrangement between the ceramic injector and an apparatus for retaining the injector to the boiler in a sealing relationship. The injector has an outwardly extending ceramic flange. The retaining apparatus has a pair of plates and a device for selectively tightening these plates toward one another. In a preferred embodiment one of these retainer plates is a retainer ring. With this arrangement the annular flange can be clamped between the retainer ring and the retainer plate by utilizing the tightening device.

A seal between the above elements has been accomplished by providing the retainer ring with an annular groove. Within the groove is placed a generally C-shaped annular spring which exerts an annular biasing force between the ceramic flange and the retainer ring. This unique arrangement causes a very effective seal to be maintained when high heat, high pressure conditions exist in the boiler. When the metallic retainer ring and retainer plate expand away from the ceramic flange the annular spring expands correspondingly to maintain tight sealing engagement between the ceramic flange and the retaining apparatus.

It is important to note that with the above arrangement the novel injector assembly can be easily mounted to the outside boiler wall. This is accomplished by welding the retainer ring to the boiler wall all along the ring's outer circumference. Because the retainer ring and the boiler are both metallic, a seal of good integrity is maintained during operation of the boiler.

It is also important to note that all components of the novel injector assembly are easy to manufacture and can be easily assembled. This is necessary for the high production requirements of torpedo components.

OBJECTS OF THE INVENTION

An object of the present invention is to overcome the aforementioned problems associated with prior art injector assemblies for use with high heat, high pressure, highly corrosive boiler operations.

Another object is to provide an injector assembly which can maintain a seal with a high temperature, high pressure boiler when the injector assembly utilizes a ceramic injector and a metallic retaining apparatus.

A further object is to provide an injector assembly which maintains a good seal between its parts when these parts expand away from one another due to different coefficients of expansion.

Still a further object is to provide a high temperature, high pressure injector assembly which is easy to manufacture and mount to a boiler, and yet which will maintain a high integrity seal with the boiler even though the fuel used in the boiler presents a highly corrosive environment.

These and other objects of the invention will become more readily apparent from the ensuing specification when taken together with the drawings.

DESCRIPTION OF THE DRAWINGS

FIG. 1 is an exemplary longitudinal cross sectional view of a preferred injector assembly mounted to a torpedo boiler wall with the boiler in an off condition (no heat condition).

FIG. 2 is a similar view as FIG. 1 except the boiler is operating (high heat condition) causing metal parts to expand away from the ceramic flange.

FIG. 3 is an exemplary longitudinal cross sectional view of a modified injector assembly mounted to a torpedo boiler wall with the boiler in an off condition (no heat condition).

FIG. 4 is a similar view as FIG. 3 except the boiler is operating (high heat condition) causing metal parts to expand away from the ceramic flange.

DESCRIPTION OF THE PREFERRED EMBODIMENTS

Referring now to the drawings wherein like reference numerals designate like or similar parts throughout the several views there is shown in FIG. 1 an exemplary wall portion 10 of a combustion chamber or boiler of a torpedo (not shown). Typically, a torpedo boiler reaches a temperature of 1700 degrees fahrenheit and a pressure of 300 psi. Also, these boilers utilize a highly corrosive fuel, such as lithium/sulfurhexafluoride. Because of the high heat, high pressure and the highly corrosive fuel, the torpedo boiler presents a very hostile environment.

As shown in FIG. 1, a generally cylindrical ceramic injector 12 is provided with an outwardly extending annular ceramic flange 14. The ceramic material may be silicon nitride. The injector extends forwardly into the boiler through an opening 16 in the boiler wall 10. With this arrangement the nozzle end 18 of the injector 12 is located within the boiler and the ceramic flange 14 is located outside the boiler. The ceramic flange 14 extends radially outwardly beyond the boiler opening 16 and preferably has forward and rearward annular flat surfaces 20 and 22, respectively, which face oppositely away from one another.

A metallic retaining means 24 is provided which has a forward retainer plate 26, a rearward retainer plate 28 and a tightening means generally shown at 30. All of these components may be made from metal, such as hastelloy. In the preferred embodiment the forward retaining retainer plate 26 is a retainer ring. The forward retainer ring 26 and the rearward retainer plate 28 preferably have forward and rearward flat surfaces respectively so that the rearward surface of the forward retainer ring 26 can make flat surface engagement with the forward surface 20 of the ceramic flange and the forward surface of the rearward retainer plate 28 can make flat surface engagement with the rearward surface 22 of the ceramic flange.

The tightening means 30 is for clamping the ceramic flange 14 tightly between the retainer ring 26 and the retainer plate 28 in the preferred flat surface direct engagement. An exemplary tightening means includes a ring 32 which is fixedly attached to the forward retainer ring 26 and extends rearwardly and perpendicularly therefrom to form a ring plate therewith. The tightening means further includes the tightening ring 32 and the rearward retainer plate 28 engaging one another in a threaded relationship at 34 so that the forward retainer ring 26 and the rearward retainer plate 28 can be selectively moved toward one another to clamp the ceramic flange 14 therebetween. The tightening means may take other forms such as bevelled retaining rings or separate screw methods.

It is important that the forward retainer ring 26 be of a metal which can be welded to the exterior of the boiler wall 10 to provide a seal which will withstand high temperatures and high pressures. The boiler wall is commonly stainless steel. A compatible metal for the forward retainer ring can be hastelloy. The seal can be accomplished by an annular weld 36 of the outer periphery of the forward retainer ring 26 to the exterior of the boiler wall 10. This weld will withstand the high heat of the boiler and the high pressure of the boiler, which pressure is first exerted through the opening 16 and then along the surface engagement of the forward surface of the retainer ring 26 with boiler wall 10.

Even though the annular weld 36 will stop pressure leaks along the forward surface of the retainer ring 26 there is another leak area along the engagement of the forward surface 20 of the ceramic flange 14 with the rearward surface of the forward retainer ring 26. This area is particularly troublesome when the high heat from the boiler wall 10 heats up the retaining means 24. Because of the different coefficients of expansion of the retaining means 24 with respect to the ceramic flange 14, the retainer ring 26 and the retainer plate 28 will expand away from the ceramic flange 14 to present a gap 38 as illustrated in FIG. 2. In order to overcome this problem an annular spring biased means 40 is provided for closing the gap 38 and maintaining a seal at all times between the ceramic flange 14 and the metallic retaining means 24. The spring biased means 40 may be an annular metallic spring with a generally C or U shaped cross section. The spring 40 is preferably disposed in an annular groove 42 within the rearward surface of the forward retainer ring 26. When the gap 38 (see FIG. 2) occurs due to high heat conditions the spring 40 annularly expands to maintain a high integrity seal between the ceramic flange 14 and the retaining means 24. It is preferable that the seal be maintained between the forward surface 20 of the ceramic flange and the rearward surface of the forward retainer ring 26 so that the high pressure will not be exerted on the threads at 34.

The ceramic injector 12 has a rearward flat surface 43 which includes and is coextensive with the rearward flat surface 22 of the ceramic flange. The ceramic injector 12 is also provided with a central fuel passageway 44 which has a rearward fuel inlet 46 and a forward fuel outlet 48.

The forward flat surface of the rearward retainer plate 28 extends across and engages the rearward surface 43 of the injector in a sealing relationship about the rearward inlet opening 46 of the fuel passageway 44. In order to get fuel to the fuel passageway 44 the rearward retainer plate 28 is provided with passageways 50, the fuel tube being received within a portion of this passageway and sealed therein by a ring weld 54. In order to provide access for making the weld 54, the ring 32 and the plate 28 may be provided with a bore 55 which transverses to their longitudinal axes, as shown in FIGS. 1 and 2.

In order to make the seal between the rearward surface 43 of the ceramic injector and the forward surface of the retainer plate 28, the latter surface may be provided with a nickel braze upon which there is placed a sheet of Palniro 56. The Palniro 56 may be a combination of 50% gold, 25% nickel and 25% palladium. The sealing effect of the Palniro may be accomplished by threading the retainer plate 28 into the tightening ring 32 until the ceramic flange is tightly clamped. The whole injector with the sheet of Palniro in place is then subjected to oven heat of about 2050 degrees fahrenheit for about 10 minutes. The Palniro sheet then brazes across to effectively seal the rearward surface 43 of the injector to the forward surface of the rearward retainer plate 28.

Because of the high heat that the forward portion of the ceramic injector is subjected to in the boiler, it is desirable that the injector be cooled in some manner. With proper cooling the ceramic material of the injector will maintain good structural integrity and have a longer life. This cooling may be accomplished by providing the injector with an annular cavity 58 about the central fuel passageway 44, the annular cavity having a rearward annular opening 60. This annular cavity 58, which can be a vacuum or air filled is sealed at its rearward opening 60 by the rearward retainer plate 28.

The other embodiment shown in FIGS. 3 and 4 differs from the first described preferred embodiment in several respects. Instead of a rearward retainer plate the injector in FIGS. 3 and 4 utilizes a rearward retainer ring 62 which surrounds the rearward fuel inlet 4 and the annular opening 60 of the cavity 58. In this embodiment a spacer sleeve 64 with an outwardly extending annular flange 66 is mounted in the rearward annular opening 60 of the injector cavity. The inner surface 68 of the sleeve and the outer end 70 of the flange of the sleeve engage inner and outer oppositely facing annular surfaces within the injector cavity respectively at the cavity opening 60. With this arrangement the structural integrity of the injector at its opening 60 is maintained. The sleeve 64 is fixed to the injector 12 with a braze 72 similar to the braze at 56 (see FIGS. 1 and 2) which seals the injector's rearward surface 43 to the retaining plate 28. The flange 66 is provided with apertures 71 to reduce thermal conduction between the injector's outside wall and its inside fuel passageway 44. The air within the cavity 58 will also help cool the injector. The sleeve can serve another function by having a rearward extension 74 for tightly receiving a fuel supply tube 76.

In both embodiments the tightening means 32 and the rearward retainer plate 28 or the rearward retainer ring 62 may be provided with flattened portions 78 to enable wrenching the parts together in the clamping function.

OPERATION OF THE INVENTION

In FIG. 1 the boiler is off and the boiler wall 10 is cool. During this time the forward retainer ring 26 and the rearward retainer plate 28 are preferably in direct engagement with the forward and rearward surfaces 20 and 22 of the ceramic flange with the annular spring 40 maintaining a seal therebetween. When the boiler is fired up the high heat causes an annular gap 38, as shown in FIG. 2, between the forward surface 20 of the ceramic flange and the rearward surface of the forward retainer ring 26. When this occurs the spring 40 expands to close the gap, thus maintaining a high integrity seal between the surfaces. During operation of the boiler the injector 12 is cooled by the annular cavity 58 which breaks the conduction path. The operation of the embodiment in FIGS. 3 and 4 is similar except the retainer ring 62 is used instead of a retainer plate. Also, the structural integrity of the injector is maintained in a different manner by the sleeve 64 and the flange 66. It should be noted that the injector assemblies have parts which can be easily manufactured and easily assembled. Once assembled the injector assembly can be easily mounted on the outside of the boiler wall 10 by an annular bead weld 36.

Obviously, many modifications and variations of the present invention are possible in the light of the above teachings. It is therefore to be understood that within the scope of the appended claims, the invention may be practiced otherwise than as specifically described.

What is claimed is:

1. An injector assembly comprising:

a ceramic injector having an outwardly extending flange and having a central fuel passageway which has a forward fuel outlet and a rearward fuel inlet, the injector flange having forward and rearward surfaces which face oppositely away from one another;

a retainer engageable with the injector flange on opposite sides thereof for retaining the injector having forward and rearward retainer plates and including a tightener, the tightener engaging the forward retainer plate with the forward surface of the flange and engaging the rearward retainer plate with the rearward surface of the flange, the tightener including a tightener coupling fixedly attached to the forward retainer plate and extending perpendicularly therefrom, the tightener coupling and the rearward retainer plate engaging one another for clamping the ceramic flange between the forward retainer plate and the rearward retainer plate;

the forward retainer plate including a groove;

the injector and the retainer having different coefficients of expansion;

a spring biased seal disposed in the groove and located between the retainer and the flange;

the rearward retainer plate extending across and sealing the injector about the rearward fuel inlet and having a fuel passageway which communicates with the central fuel passageway at the rearward fuel inlet.

2. An injector assembly as claimed in claim 1 wherein:

the retainer is a metal; and the spring biased seal has a generally C shaped cross section of substantially the same metal as the metal of the retainer.

3. An injector assembly as claimed in claim 1 wherein:

the injector has an annular cavity about its central fuel passageway, the annular cavity having a rearward annular opening; and the rearward retainer plate extends across the rearward annular opening to seal said annular cavity.

4. An injector assembly comprising:

a ceramic injector having an outwardly extending flange and having a central fuel passageway which has a forward fuel outlet and a rearward fuel inlet, the injector flange having forward and rearward surfaces which face oppositely away from one another;

a retainer engageable with the injector flange on opposites sides thereof for retaining the injector having forward and rearward retainer plates and including a tightener, the tightener engaging the forward retainer plate with the forward surface of the flange and engaging the rearward retainer plate with the rearward surface of the flange, the tightener including a tightener coupling fixedly attached to the forward retainer plate and extending perpendicularly therefrom, the tightener coupling and the rearward retainer plate engaging one another for clamping the ceramic flange between the forward retainer plate and the rearward retainer plate;

the forward retainer plate including a groove;

the injector and the retainer having different coefficients of expansion;

a spring biased seal disposed in the groove and located between the retainer and the flange;

the injector having a cavity about the central fuel passageway with a rearward annular opening; and the rearward retainer plate being a ring which surrounds the central fuel passageway and the rearward annular opening.

5. An injector assembly as claimed in claim 4 including:

a sleeve with an outwardly extending flange which is disposed in the rearward annular opening to provide structural support therefor;

the flange of the sleeve having apertures opening into the annular cavity; and wherein the sleeve extends rearward beyond the injector for receiving a fuel tube in communication with the central fuel passageway.

6. An injector assembly for use with a high pressure, high heat combustion chamber wherein the injector assembly has an injector which is adapted to extend forwardly into the chamber through a metallic chamber wall comprising:

the injector being ceramic and having an outwardly extending annular ceramic flange;

metallic retaining means having a forward retainer plate, a rearward retainer plate and a tightening means;

the tightening means being for clamping the ceramic flange between the forward and rearward retainer plates;

an annular spring biased means associated with the ceramic flange and the retaining means for maintaining a seal between the ceramic flange and the metallic retaining means when high temperatures within the combustion chamber causes different expansions of the ceramic flange and the retaining means, whereby upon the retaining means of the injector assembly being fixedly welded to the outside of the combustion chamber and the chamber is operated under high heat, high pressure conditions, a seal is maintained between the injector assembly and the combustion chamber.

7. An injector assembly as claimed in claim 6 in which:

the forward retainer plate comprises a ring which has a rearward facing annular groove; and the annular spring biased means comprises a generally C shaped spring which is disposed in the annular groove of the forward retainer ring.

8. An injector assembly as claimed in claim 7 wherein the tightening means includes:

a tightening ring fixedly attached to the forward retainer ring and extending perpendicularly and rearwardly therefrom to form a ring plate; and wherein the tightening ring and the rearward retainer plate engage one another in a threaded relationship for selectively clamping the ceramic flange between the forward retainer ring and the rearward retainer plate.

9. An injector assembly as claimed in claim 8 wherein:

the forward retainer ring and the tightening ring are metal of substantially the same kind to form a ring plate which can be welded to the metallic chamber wall in a sealing relationship.

10. An injector assembly as claimed in claim 9 wherein:

the rearward retainer plate and the ring plate formed by the forward retainer ring and the tightening ring have flattened portions which allow wrenches to selectively tighten the forward retainer ring and the rearward retainer plate on the ceramic flange.

11. An injector assembly as claimed in claim 9 wherein:

the injector includes a central fuel passageway which has a rearward fuel inlet and a forward fuel outlet;

the injector further having an annular cavity about its central fuel passageway, the annular cavity having a rearward annular opening;

the rearward retainer plate extending across and sealing the injector about the rearward fuel inlet and the rearward annular opening of the annular cavity; and the rearward retainer plate having a fuel passageway which communicates with the central fuel passageway at the rearward fuel inlet.

12. An injector assembly as claimed in claim 9 including:

the injector having a central fuel passageway with a rearward fuel inlet and a forward fuel outlet;

the injector having an annular cavity located about the fuel passageway, the annular cavity having a rearward annular opening;

the rearward plate being a ring which surrounds the fuel inlet and the rearward annular opening;

a spacer sleeve having an outwardly extending annular flange mounted in the rearward annular opening of the injector;

the sleeve and the outer end of the flange engaging inner and outer oppositely facing annular surfaces respectively within the injector's annular opening; and the annular flange of the spacer sleeve having apertures.

* * * * *